US008475986B2

(12) United States Patent
Oki

(10) Patent No.: US 8,475,986 B2
(45) Date of Patent: Jul. 2, 2013

(54) TONER

(75) Inventor: Masahiro Oki, Iruma (JP)

(73) Assignee: Seiko Epson Corporation, Tokyo (JP)

( * ) Notice: Subject to any disclaimer, the term of this patent is extended or adjusted under 35 U.S.C. 154(b) by 225 days.

(21) Appl. No.: 13/042,845

(22) Filed: Mar. 8, 2011

(65) Prior Publication Data

US 2011/0223526 A1 Sep. 15, 2011

(30) Foreign Application Priority Data

Mar. 9, 2010 (JP) ..... 2010-052400

(51) Int. Cl.
*G03G 9/08* (2006.01)

(52) U.S. Cl.
USPC ..... 430/108.7; 399/252

(58) Field of Classification Search
USPC ..... 430/108.7; 399/252
See application file for complete search history.

(56) References Cited

U.S. PATENT DOCUMENTS

2008/0096116 A1* 4/2008 Utsumi et al. ..... 430/48

FOREIGN PATENT DOCUMENTS

JP 2009-058844 3/2009

* cited by examiner

*Primary Examiner* — Mark A Chapman
(74) *Attorney, Agent, or Firm* — DLA Piper LLP (US)

(57) ABSTRACT

The invention is to provide a toner with a small difference of charging properties and an excellent cleaning property. The toner includes toner particles of cylindrical bodies.

10 Claims, 3 Drawing Sheets

TONER

BACKGROUND

1. Technical Field

The present invention relates to a toner.

2. Related Art

Generally, an image forming apparatus such as a printer, a copier, or a facsimile employing electrophotography forms an image formed from a toner on a printing medium such as paper by a series of image forming processes of a charging process, an exposure process, a development process, a transfer process, and a fixing process.

Such an image forming apparatus is provided with a development device having a development roller supporting a toner. The development apparatus is used in a state in which the development roller is opposed to a photosensitive drum supporting an electrostatic latent image, and the latent image on the photosensitive drum is made visible (developed) as a toner image by applying a toner to the photosensitive drum from the development roller.

As a method of producing a toner, a crushing method or a polymerization method is used (e.g., see JP-A-2009-058844).

Generally, it is considered that toner particles are substantially circular for the purpose of reducing a difference of charging properties among particles. However, when a degree of circularity is too high, the toner particles turn between a photoreceptor and a cleaning blade and enter a gap when the toner remaining on a photoreceptor is removed by the cleaning blade, and thus it is difficult to clean the toner. There is a method of applying mechanical force after granulation to reduce the degree of circularity degree of the toner particles to obtain toner particles with a proper degree of circularity. However, when such a method is used, accidental cohesion among particles, cracking of particles, and the like may easily occur.

SUMMARY

An advantage of some aspects of the invention is to provide a toner with a small difference of charging properties among toner particles and an excellent cleaning property.

According to an aspect of the invention, there is provided a toner including a plurality of toner particles, wherein the toner particles are formed of a resin material, a coloring agent, and cylindrical bodies mainly including silicate.

With such a configuration, it is possible to provide the toner with a small difference of charging properties among toner particles and an excellent cleaning property.

In the toner according to the aspect of the invention, it is preferable that the toner particles further includes wax.

With such a configuration, a detachment property of the toner can be excellent. Particularly, in the aspect of the invention, when the toner particles include the cylindrical bodies, it is possible to very appropriately keep wax in an empty portion of the cylindrical bodies at the preserving time, it is possible to reliably prevent a bad effect caused by transuding of the wax from occurring, it is possible to discharge the wax to the outside of the cylindrical bodies at the fixing time, and it is possible to reliably exhibit a function of the wax.

In the toner of the aspect of the invention, it is preferable that the content of the cylindrical bodies is 0.2 wt % or more and 5.0 wt % or less.

With such a configuration, a fixing property of the toner to a printing medium is excellent, and it is possible to more effectively exhibit the effect of including the cylindrical bodies.

In the toner of the aspect of the invention, it is preferable that the cylindrical bodies are subjected to a surface treatment by quaternary amine.

With such a configuration, it is possible to optimize affinity between the resin material constituting the toner particles and the cylindrical bodies, it is possible to prevent the cylindrical bodies from being accidentally detached from the toner particles at the preserving time, it is possible to reliably keep the cylindrical bodies in the vicinity of the surfaces of the toner particles, and it is possible to more effectively exhibit the effect caused by including the cylindrical bodies.

In the toner according to the aspect of the invention, it is preferable that the silicate has a smectite structure or a sericite structure.

With such a configuration, it is possible to optimize affinity between the resin material constituting the toner particles and the cylindrical bodies, it is possible to prevent the cylindrical bodies from being accidentally detached from the toner particles at the preserving time, it is possible to reliably keep the cylindrical bodies in the vicinity of the surfaces of the toner particles, and it is possible to more effectively exhibit the effect caused by including the cylindrical bodies.

In the toner according to the aspect of the invention, it is preferable that polyester resin is included as the resin material.

With such a configuration, a fixing property of the toner to a printing medium, a coloring property, and a transparency property can be made to be particularly good. In addition, it is possible to optimize affinity between the resin material constituting the toner particles and the cylindrical bodies, it is possible to prevent the cylindrical bodies from being accidentally detached from the toner particles at the preserving time, it is possible to reliably keep the cylindrical bodies in the vicinity of the surfaces of the toner particles, and it is possible to more effectively exhibit the effect caused by including the cylindrical bodies.

In the toner according to the aspect of the invention, it is preferable that an average degree of circularity of the toner particles is 0.910 or more and 0.965 or less.

With such a configuration, a difference of charging properties among toner particles can be small and a cleaning property can be particularly good.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
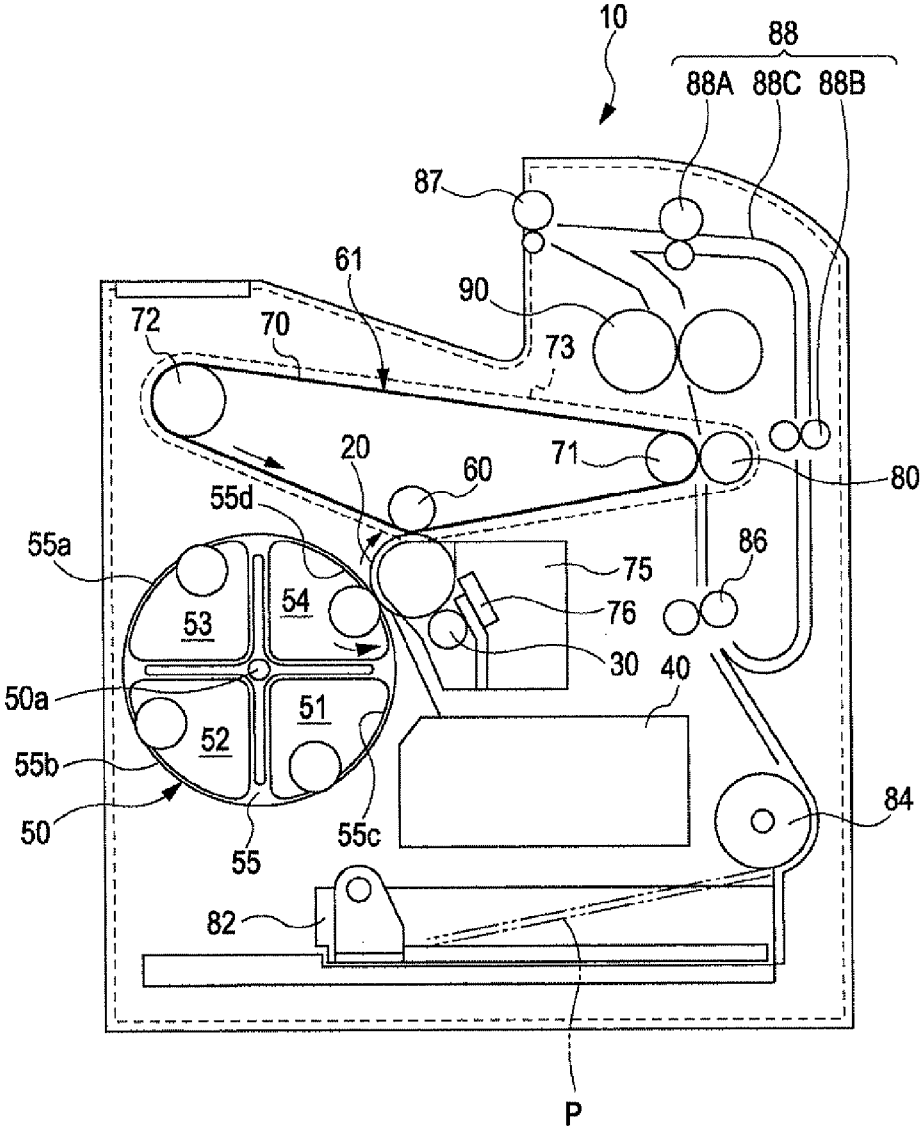
FIG. 1 is a schematic cross-sectional view illustrating an example of an overall configuration of an image forming apparatus to which a toner of the invention is applied.

Hereinafter, preferred embodiments of the invention will be described in detail.

Toner

First, a toner of the invention will be described.

The toner of the invention includes a plurality of toner particles, and the toner particles are formed of a resin material, a coloring agent, and mainly silicate and include cylindrical bodies.

Constituent Material of Toner Particles

Resin Material

Toner particles are formed of a material including a resin material (bonding resin). Accordingly, a fixing property of the toner to a printing medium can be made to be excellent.

In the invention, the resin material constituting the toner particles is not particularly limited, and, for example, a known resin can be used, but it is preferable to use polyester resin. Accordingly, a fixing property of the toner to a printing medium, a coloring property, and a transparency property can be made to be particularly good. In addition, it is possible to optimize affinity between the resin material constituting the toner particles and cylindrical bodies to be described later, it is possible to prevent the cylindrical bodies from being accidentally detached from the toner particles at the preserving time, it is possible to reliably keep the cylindrical bodies in the vicinity of the surfaces of the toner particles, and it is possible to more effectively exhibit the effect caused by including the cylindrical bodies.

In the invention, the resin material constituting the toner may be formed of a single component, and may include a plurality of resin components.

A softening point of the resin material constituting the toner particles is preferably 50° C. or higher and 190° C. or lower, more preferably 55° C. or higher and 170° or lower, and even more preferably 60° C. or higher and 160° or lower. Accordingly, both the fixing property of the toner and heat conservation resistance can made to be high. In the invention, the softening point indicates a softening start temperature regulated by measurement conditions (a temperature rising rate: 5° C./min, and a die hole diameter: 1.0 mm) in a rising flow tester (manufactured by Shimazu Corporation).

The content of the resin material in the toner is preferably 65 wt % or more and 95 wt % or less, more preferably 70 wt % or more and 95 wt % or less, and even more preferably 75 wt % or more and 95 wt % or less. Accordingly, both of the fixing property of the toner and heat conservation resistance can be made to be high.

Coloring Agent

The toner particles are formed of a material including a coloring agent.

Various pigments and dyes may be used as the coloring agent.

The content of the coloring agent in the toner is preferably 5 wt % or more and 25 wt % or less, more preferably 5 wt % or more and 20 wt % or less, and even more preferably 5 wt % or more and 18 wt % or less. Accordingly, a fixing property (an adhesion property) of the toner to a printing medium can be sufficiently excellent, and it is possible to form a visible image (a toner image) with a sufficient density.

Cylindrical Body

The toner particles are mainly formed of silicate and include cylindrical bodies. Accordingly, a degree of circularity of the toner particles can be made to be appropriately low, as a result, a difference of charging properties among the toner particles is sufficiently small, and a cleaning property can be made to be excellent.

The fixing of the toner is generally performed by heating. However, when the toner particles include the cylindrical bodies, heat energy added to the toner can be efficiently transferred to the resin material. Accordingly, it is possible to reduce energy necessary for the fixing, which is preferable from the view point of energy saving. Even when the fixing temperature is relatively low, it is possible to reliably fix the toner to the printing medium, and it is possible to appropriately cope with high-speed printing.

When the toner particles include the cylindrical bodies, the charging property of the entirety of toner particles can be made to be particularly good. It is thought that this is because the cylindrical bodies constituting the toner particles are mainly formed of silicate and are formed in the cylindrical shape, and thus it is possible to effectively keep charges.

When the toner particles include the cylindrical bodies, it is possible to ensure moderate gaps among toner particles transferred to a printing medium by a transfer process in an image forming method to be described later. Accordingly, the toner particles are reliably dissolved on the printing medium when the toner fixed by a fixing process, the toner particles are reliably mixed with each other, and thus it is possible to reliably represent a desired color tone for the formed image.

The cylindrical bodies hardly have a bad influence on colors of the formed image.

When the toner particles include the cylindrical bodies and the toner particles include wax to be described later, it is possible to very appropriately keep the wax in an empty portion of the cylindrical bodies at the preserving time of the toner, it is possible to reliably prevent a bad effect caused by transuding of the wax from occurring, it is possible to discharge the wax to the outside of the cylindrical bodies at the fixing time, and it is possible to reliably exhibit a function of the wax.

Although it is satisfactory that the cylindrical bodies may be mainly formed of silicate, it is preferable that the silicate constituting the cylindrical bodies have a smectite structure $((Na, Ca_{1/2})_{0.2\ to\ 0.6}(R^{3+}, R^{2+}, Li)_{2\ to\ 3}(Si, Al)_4O_{10}(OH)_2 \cdot nH_2O$: where $R^{3+}$ is a trivalent metal ion mainly formed of $Al^{3+}$ and $Fe^{3+}$, and $R^{2+}$ is a bivalent metal ion mainly formed of $Mg^{2+}$ and $Fe^{2+}$) or a sericite structure $(K_{0.85}(Al_{1.9}R_{0.1}{}^{2+})(Si_{3.25}Al_{0.75})O_{10}(OH)_2$: where $R^{2+}$ is a divalent metal ion mainly of formed of $Mg^{2+}$), and it is more preferable that the silicate has the smectite structure as a main component and has the sericite structure. Accordingly, it is possible to optimize affinity between the resin material constituting the toner particles and the cylindrical bodies, it is possible to prevent the cylindrical bodies from being accidentally detached from the toner particles at the preserving time, it is possible to reliably keep the cylindrical bodies in the vicinity of the surfaces of the toner particles, and it is possible to more effectively exhibit the effect caused by including the cylindrical bodies.

It is preferable that the cylindrical bodies are subjected to a surface treatment by quaternary amine (particularly, tetraalkylammonium). Accordingly, it is possible to optimize affinity between the resin material constituting the toner particles and the cylindrical bodies, it is possible to prevent the cylindrical bodies from being accidentally detached from the toner particles, it is possible to reliably keep the cylindrical bodies in the vicinity of the surfaces of the toner particles at the preserving time, and it is possible to more effectively exhibit the effect caused by including the cylindrical bodies. Such an effect is remarkably exhibited when the toner is produced using a method to be described later.

A length of the cylindrical bodies is not particularly limited, but is preferably 60 nm or more and 500 nm or less, and more preferably 80 nm or more and 300 nm or less. Accordingly, the effect caused by including the cylindrical bodies is more remarkably exhibited.

An inner diameter (a diameter of an empty portion) of the cylindrical bodies is not particularly limited, but is preferably 10 nm or more and 300 nm or less, and more preferably 50 nm or more and 200 nm or less. Accordingly, the effect caused by including the cylindrical bodies is more remarkably exhibited. Particularly, when the toner particles include wax to be described later and the inner diameter of the cylindrical bodies is in the above-described range, it is possible to more appropriately keep wax in an empty portion of the cylindrical bodies at the preserving time, it is possible to more reliably prevent a bad effect caused by transuding of the wax from occurring.

An outer diameter of the cylindrical bodies is not particularly limited, but is preferably 30 nm or more and 320 nm or less, and more preferably 70 nm or more and 220 nm or less. Accordingly, the effect caused by including the cylindrical bodies is more remarkably exhibited.

The content of the cylindrical bodies in the toner is not particularly limited, but is preferably 0.2 wt % or more and 5.0 wt % or less, and more preferably 0.5 wt % or more and 3.0 wt % or less. When the content of the cylindrical bodies in the toner is in the above-described range, the fixing property of the toner to the printing medium is sufficiently good, and it is possible to more effectively exhibit the effect caused by including the cylindrical bodies.

Wax

Although it is satisfactory that the toner particles include the resin material, the coloring agent, and the cylindrical bodies, it is preferable to further include wax. Accordingly, a detachment property of the toner can be made to be excellent. Particularly, in the aspect of the invention, when the toner particles include the cylindrical bodies, it is possible to very appropriately keep wax in an empty portion of the cylindrical bodies at the preserving time, it is possible to reliably prevent a bad effect caused by transuding of the wax from occurring, it is possible to discharge the wax to the outside of the cylindrical bodies at the fixing time, and it is possible to reliably exhibit a function of the wax.

An example of the wax may be hydrocarbon-based wax such as ozocerite, cercine, paraffin wax, microwax, microcrystalline wax, petrolatum, and Fischer-Tropsch wax; ester-based wax such as carnauba wax, rice wax, methyl laurate, methyl myristate, methyl palmitate, methyl stearate, butyl stearate, Candelilla wax, cotton raw, wood raw, meat raw, lanolin, montan wax, fatty acid ester, and polyglyceryl fatty acid ester; olefin-based wax such as polyethylene wax, polypropylene wax, oxidation-type polyethylene wax, and oxidation-type polypropylene wax; amide-based wax such as 12-hydroxystearic acid amide, stearic acid amide, and phthalic anhydride imide; ketone-based wax such as laurone and stearone; and eter-based wax. One or two or more kinds among them may be combined, but the carnauba wax is preferable among them. When the toner particles include the carnauba wax, from chemical and structural correlation of silicate constituting the cylindrical bodies, it is possible to more preferably keep the wax in an empty portion of the cylindrical bodies at the preserving time, and it is possible to reliably prevent a bad effect caused by transuding of the wax from occurring.

The content of the wax in the toner is not particularly limited, but is preferably 1 wt % or more and 15 wt % or less, and more preferably 1 wt % or more and 10 wt % or less. Accordingly, the above-described effect is more remarkably exhibited.

Other Components

The toner may include components other than the above-described components. An example of such components may be magnetic powder, a charging control agent, an additive agent, and the like.

An example of the magnetic powder may be powder formed of a magnetic material including a magnetic metal, for example, metal oxide such as magnetite, maghemite, various ferrites, copper II oxide, nickel oxide, zinc oxide, zirconium oxide, titanium oxide, and magnesium oxide, or Fe, Co, and Ni.

An example of the charging control agent may be benzoate metal salt, salicylic metal salt, benzilic acid metal salt, alkylsalicylate metal salt, azoic pigment, metal bisazoic dye, calixarene phenol-based condensate, catechol metal salt, chlorinated polyester, fluorine-containing compound, and the like.

An example of the additive agent may be silica, titanium oxide, and the like.

Shape of Toner Particle

An average particle diameter of the toner particles formed of the above-described material is preferably 0.5 μm or more and 5.0 μm or less, more preferably 0.8 μm or more and 4.0 μm or less, and still more preferably 1.0 or more and 3.5 μm or less. When the average particle diameter of the toner particles is a value in the above-described range, the toner particles are reliably prevented from accidentally cohering at the preserving time, a difference of characteristics among the toner particles is made to be small, and thus it is possible to sufficiently raise resolution of a toner image formed by the toner. In the invention, "average particle diameter" indicates an average particle diameter based on volume.

An average degree of circularity of the toner particles is preferably 0.910 or more and 0.965 or less, and more preferably 0.940 or more and 0.965 or less. Accordingly, a difference of charging properties among the toner particles gets smaller, and a cleaning property can be made to be particularly good. In the invention, "circularity" is a value represented by $L_0/L_1$ when a boundary length of a projection image of the measurement target toner particles is $L_1$ [μm] and a boundary length of a true circle of the same area as the area of the projection image of the toner particles is $L_0$ [μm]. The circularity of the toner particles can be acquired using a flow-type particle shape analyzer (e.g., FPIA-3000 and FPIA-3000S manufactured by Sysmex Corporation. and FPIP-1000 manufactured by Toa Medical Electronics Co., Ltd.).

Method of Producing Toner

Next, an ideal preferred embodiment of a method of producing the above-described toner will be described.

The method of producing the toner of the embodiment includes a resin solution preparing process of dissolving a resin material in an organic solvent and preparing a resin solution including a coloring agent and cylindrical bodies, an O/W emulsified liquid preparing process of adding an aqueous liquid in the resin solution to prepare an O/W emulsified liquid through a W/O emulsified liquid, an integration process of integrating a dispersed material included in the O/W emulsified liquid and obtaining the integrated particles, and an organic solvent removing process of removing the organic solvent included in the integrated particles. By producing toner using such a method, particle size distribution of the toner particles constituting the finally obtainable toner can be made to be very sharp, and a difference of characteristics among the toner particles can be made to be particularly small.

Hereinafter, the processes of the method of producing the toner will be described in detail.

Resin Solution Preparing Process

First, a resin material is dissolved in an organic solvent, and a resin solution including a coloring agent and cylindrical bodies is prepared.

As the organic solvent, it is satisfactory to use anything to dissolve at least a part of the resin material, but it is preferable to use an organic solvent with a boiling point lower than that of an aqueous liquid to be described later. Accordingly, it is possible to easily remove the organic solvent in the process to be described later.

In addition, it is preferable that compatibility of the organic solvent with respect to the aqueous liquid (aqueous dispersion medium) to be described later is low (e.g., a solubility with respect to 100 g of the aqueous liquid at 25° C. is 30 g or less). Accordingly, in the O/W emulsified liquid (aqueous emulsified liquid) to be described later, a dispersoid formed of the toner material can be finely dispersed in a stable state.

The composition of the organic solvent may be appropriately selected according to the composition of the resin material and the coloring agent or the composition of the aqueous liquid (aqueous dispersion medium).

Such an organic solvent is not particularly limited, but may be a ketone-based solvent such as MEK and an aromatic hydrocarbon-based solvent such as toluene.

For example, the resin solution can be obtained by mixing the resin material, the coloring agent, the cylindrical bodies, the organic solvent, and the like by a stirrer or the like. As the stirrer which may be used to prepare the resin solution, for example, there is a high-speed stirrer such as DESPA (manufactured by Asada Iron Works Co., Ltd.) and T.K. robot mix/T.K. homo-disperse-2.5 type blade (manufactured by PRIMIX Corporation).

A material temperature at the stirring time is preferably 20° C. or higher and 60° C. or lower, and more preferably 30° C. or higher and 50° C. or lower.

The content of solid in the resin solution is not particularly limited, but is preferably 40 wt % or more and 75 wt % or less, more preferably 50 wt % or more and 73 wt % or less, and even more preferably 50 wt % or more and 70 wt % or less. When the content of solid is a value in the above-described range, the shape of the finally obtainable toner particles can be made to be reliably more appropriate.

In the preparation of the resin solution, all the constituent components of the resin material to be prepared may be mixed, and a part of the constituent components of the resin solution to be prepared are mixed in advance to obtain a mixture (master) and then the mixture (master) may be mixed with the other components.

O/W Emulsified Liquid Preparing Process

Next, an O/W emulsified liquid is prepared through a W/O emulsified liquid by adding an aqueous liquid in the resin solution.

As the aqueous liquid, liquid mainly formed of water may be used.

For example, the aqueous liquid may include a solvent (e.g., a solvent in which solubility of 100 parts by weight at 25° C. with respect to water is 50 parts by weight or higher) with excellent compatibility with water.

An emulsification dispersion agent may be added to the aqueous liquid as necessary. By adding the emulsification dispersion agent, it is possible to more easily prepare the aqueous emulsified liquid. The emulsification dispersion agent is not particularly limited, for example, the known emulsification dispersion agent may be used.

When the O/W emulsified liquid is prepared, for example, an alkaline material may be used. Accordingly, for example, it is possible to neutralize a functional group (e.g., carboxylic group) of the resin material, and the shape of the dispersoid in the prepared O/W emulsified liquid, uniformity of size, and a dispersion property of the dispersoid can be made to be particularly good. For this reason, the particle size distribution of the obtainable toner particles can be made to be particularly sharp. For example, the alkaline material may be added to the resin solution, and may be added to the aqueous liquid. In the preparation of the O/W emulsified liquid, the alkaline material may be divisionally added many times.

As the alkaline material, for example, there are sodium hydroxide, potassium hydroxide, and ammonia, and one or more kinds selected from them may be combined. The amount of the alkaline material used is preferably the amount (1-equivalent amount or more and 3-equivalent amount or less) corresponding to one time or more and three times or less of the amount necessary to neutralize all the carboxylic groups of the resin material, and more preferably the amount (1-equivalent amount or more and 2-equivalent amount or less) corresponding to one time or more and double or less. Accordingly, it is possible to obtain the O/W emulsified liquid in which the dispersoid with an appropriate shape is dispersed, and the particle size distribution obtainable from an integration process to be described later can be made to be sharper.

The addition of the aqueous liquid to the resin solution may be performed by any method, but it is preferable to add an aqueous liquid including water to the resin solution while stirring the resin solution. That is, it is preferable to transform a phase from the W/O type emulsified liquid (W/O emulsified liquid) to the O/W type emulsified liquid (O/W emulsified liquid) by gradually adding (dropping) the aqueous liquid to the resin solution while adding a shear to the resin solution by a stirrer or the like. Accordingly, uniformity of the size and shape of the dispersoid included in the O/W emulsified liquid can be made to be particularly high, the particle size distribution of the toner particles constituting the finally obtainable toner can be made to be very sharp, and the difference of characteristics among the toner particles can be, made to be particularly small.

As a stirrer which can be used to prepare the O/W emulsified liquid, for example, there is a high-speed stirrer or high-speed disperser such as DESPA (manufactured by Asada Iron Works Co., Ltd.), a T.K. robot mix/T.K. homo-disperse-2.5 type blade (manufactured by PRIMIX Corporation), a thrasher (manufactured by Mitsui Mining Co., Ltd.), and Cavitron (manufactured by EuroTec Co., Ltd.).

When the aqueous liquid is added to the resin solution, it is preferable to perform the stirring in which a blade tip speed is 10 m/second or higher and 20 m/second or lower, and it is more preferable to perform the stirring in which the blade tip speed is 12 m/second or higher and 18 m/second or lower. When the blade tip speed is a value in the above-described range, it is possible to efficiently obtain the O/W emulsified liquid, a difference of the shape and size of the dispersoid in the O/W emulsified liquid can be made to be small, and a uniform dispersion property of the dispersoid can be made to be particularly good while preventing excessively fine dispersoid and coarse particles from occurring.

The content of solid in the O/W emulsified liquid is not particularly limited, but is preferably 5 wt % or more and 55 wt % or less, and more preferably 10 wt % or more and 50 wt % or less. Accordingly, productivity of the toner can be made to be particularly good while more reliably preventing the dispersoids in the O/W emulsified liquid from accidentally cohering to each other.

A material temperature in the process is preferably 20° C. or higher and 60° C. or lower, and more preferably 20° C. or higher and 50° C. or lower.

Integration Process

Then, the plurality of dispersoids are integrated to obtain integrated particles. Generally, in the integration of the dispersoids, the dispersoids including the organic solvent collide, thereby integrating the dispersoids.

The integration of the plurality of dispersoids is performed by adding an electrolyte to the O/W emulsified liquid while stirring the O/W emulsified liquid. Accordingly, it is possible to easily and reliably obtain integrated particles. In addition, it is possible to control the particle diameter of the integrated particles and the particle size distribution.

The electrolyte is not particularly limited, and one kind or two or more kinds of the known organic and inorganic aqueous salt or the like may be combined.

It is preferable that the electrolyte is monovalent positive ion salt. Accordingly, the particle size distribution of obtainable integrated particles can be made to be particularly sharp. By using the monovalent positive ion salt, it is possible to reliably prevent the coarse particles from occurring in the process.

In the above description, the electrolyte is preferably hydrosulfate (e.g., sodium sulfate and ammonium sulfate) or carbonate, and particularly preferably hydrosulfate. Accordingly, it is possible to particularly easily control the particle diameter of the integrated particles.

The amount of the electrolyte added in the process is preferably 0.5 parts by weight or more and 3 parts by weight or less with respect to solid of 100 parts by weight included in the O/W emulsified liquid to which the electrolyte is added, and more preferably 1 part by weight or more and 2 parts by weight or less. Accordingly, it is possible to particularly easily and reliably control the particle diameter of the integrated particles, and to reliably prevent coarse particles from occurring.

It is preferable that the electrolyte is added in an aqueous solution state. Accordingly, it is possible to rapidly diffuse the electrolyte in the whole of the O/W emulsified liquid, and to easily and reliably control the amount of the added electrolyte. As a result, it is possible to obtain the integrated particles with a desired diameter and very sharp particle size distribution.

When the electrolyte is added in the aqueous solution state, the concentration of the electrolyte in the aqueous solution is preferably 2 wt % or higher and 10 wt % or lower, and more preferably 2.5 wt % or higher and 6 wt % or lower. Accordingly, it is possible to particularly rapidly diffuse the electrolyte in the whole of the O/W emulsified liquid, and to easily and reliably control the amount of the added electrolyte. By adding such an aqueous solution, the content of water in the O/W emulsified liquid is very appropriate at the time of completing the addition of the electrolyte. For this reason, a growth speed of the integrated particles after adding the electrolyte can be appropriately delayed to the extent that productivity is not reduced. As a result, it is possible to more reliably control the particle diameter. In addition, it is possible to prevent the integrated particles from being accidentally integrated.

When the electrolyte is added in the aqueous solution state, a rate of adding the electrolyte aqueous liquid is preferably 0.5 parts by weight/minute or higher and 10 parts by weight/minute or lower with respect to solid of 100 parts by weight included in the O/W emulsified liquid to which the electrolyte is added, and more preferably 1.5 parts by weight/minute or higher and 5 parts by weight/minute or lower. Accordingly, in the O/W emulsified liquid, it is possible to prevent non-uniformity of the concentration of the electrolyte from occurring, and to reliably prevent coarse particles from occurring. In addition, the particle size distribution of the integrated particles can be made to be further sharp. Furthermore, by adding the electrolyte at such a rate, it is possible to particularly easily control the rate of integration, it is possible to particularly easily control the average particle diameter of the integrated particles, and the productivity of the toner can be made to be particularly good.

The addition of the electrolyte may be divisionally performed many times. Accordingly, it is possible to easily and reliably obtain the integrated particles with a desired size.

The process is performed in a state where the O/W emulsified liquid is stirred. Accordingly, it is possible to obtain the integrated particles in which the difference of the shape and size among the particles is particularly small.

In the stirring of the O/W emulsified liquid, for example, an anchor blade, a turbine blade, a Pfaudler blade, a full-zone blade, a max blend blade, a half round blade and the like may be used as a stirring blade. Among them, the max blend blade and the full-zone blade are preferable. Accordingly, the added electrolyte is rapidly and uniformly dispersed and dissolved, and it is possible to reliably prevent non-uniformity of concentration of the electrolyte from occurring. In addition, it is possible to more reliably prevent the once-formed integrated particle from collapsing while efficiently integrating the dispersoids. As a result, it is possible to efficiently obtain the integrated particles in which the difference of the shape and particle diameter is small among the particles.

The blade tip speed of the stirring blade is preferably 0.1 m/second or higher and 10 m/second or lower, more preferably 0.2 m/second or higher and 8 m/second or lower, and even more preferably 0.2 m/second or higher and 6 m/second or lower. When the blade tip speed is in the above-described range, the added electrolyte is uniformly dispersed and dissolved, and it is possible to reliably prevent non-uniformity of concentration of the electrolyte from occurring. In addition, it is possible to even more reliably prevent the once-formed integrated particles from collapsing while efficiently integrating the dispersoids.

The average particle diameter of obtainable integrated particles is preferably 0.5 μm or more and 5 μm or less, and more preferably 1.5 μm or more and 4 μm or less. Accordingly, the particle diameter of the finally obtainable toner particles can be made to be more reliably appropriate.

Organic Solvent Removing Process

Thereafter, the organic solvent included in the O/W emulsified liquid (particularly, in the dispersoid) is removed. Accordingly, it is possible to obtain the dispersion liquid (aqueous dispersion liquid) in which the toner particles are dispersed in the aqueous dispersion medium.

The organic solvent may be removed in any method, for example, the removal may be performed by decompression. Accordingly, it is possible to efficiently remove the organic solvent while preventing the constituent material such as the resin material from being denatured.

The process temperature in the process is preferably a temperature lower than a glass transition point (Tg) of the resin material constituting the integrated particles.

The process may be performed in a state where an antifoam agent is added to the O/W emulsified liquid (dispersion liquid). Accordingly, it is possible to efficiently remove the organic solvent.

As the antifoam agent, for example, a mineral oil-based antifoam agent, a polyester-based antifoam agent, a silicon-based antifoam agent, lower alcohols, higher alcohols, fat oils, fat acid, fat acid esters, and phosphoric acid esters may be used.

The amount of the antifoam agent used is not particularly limited, but is preferably 20 ppm or more and 300 ppm or less by weight ratio with respect to solid included in the O/W emulsified liquid, and more preferably 30 ppm or more and 100 ppm or less.

In the process, at least a part of the aqueous liquid may be removed with the organic solvent.

In the process, the whole of the organic solvent (the total amount of the organic solvent included in the dispersion liquid) does not necessarily need to be removed. Even in such a case, in the process to be described later, the remaining organic solvent can be sufficiently removed.

Cleaning Process

Next, the toner particles formed as described above are cleaned.

By performing the process, it is possible to efficiently remove the organic solvent even when the organic solvent or the like is included as impurities. By performing the process, it is possible to efficiently remove the electrolyte used in the above-described process, an alkaline material, an acidic material, or a salt generated by an acid-base reaction. As a result, the amount of impurities (volatile organic compound (TVOC)) can be particularly reduced in the finally obtainable toner particles.

For example, the process may be performed by separating the toner particles by solid-liquid separation (separation from the aqueous liquid) and then re-dispersing the solid (toner particles) in the aqueous liquid (aqueous dispersion medium). The solid-liquid separation and the re-dispersion of the solid in water may be repeated many times. It is preferable to perform the cleaning until conductivity of a clear supernatant liquid of the dispersion liquid (slurry) in which the solid (toner particles) is re-dispersed in the aqueous liquid (aqueous dispersion medium) is 20 μS/cm or less.

In addition, it is preferable to perform the process under the same conditions in which the toner particles do not come to be in a dry state. Accordingly, it is possible to more reliably prevent the toner particles from cohering.

Drying Process

Thereafter, a drying process is performed to obtain the toner (an aggregate of the toner particles in the dry state) as powder. By performing such a process, reliably, the amount of moisture in the toner particles can be sufficiently lowered, and the reserving property of the toner and stability of characteristics can be made to be particularly good.

The drying process may be performed using, for example, a vacuum drier (e.g., Ribocone (manufactured by Okawara MFG. Co., Ltd.) and Nauta (manufactured by Hosokawa Micron Corporation), etc.), and a fluid-bed drier (manufactured by Okawara MFG. Co., Ltd.), and the like.

Image Forming Apparatus and Image Forming Method

Next, an image forming apparatus and an image forming method using the toner of the invention will be described.

In the image forming method according to the embodiment, a toner image is formed on a printing medium through a charging process, an exposure process, a development process, a transfer process, and a fixing process.

First, the image forming apparatus to which the image forming method using the toner of the invention is applied will be described.

FIG. 1 is a schematic cross-sectional view illustrating an example of an overall configuration of the image forming apparatus to which the toner of the invention is applied.

The image forming apparatus 10 of the embodiment shown in FIG. 1 forms an image on a printing medium by a series of an image forming process mainly including exposure, development, transfer, and fixing. As shown in FIG. 1, such an image forming apparatus 10 has a photosensitive drum (a latent image supporting body) 20 supporting an electrostatic latent image and rotating in a direction indicated by the arrow, and a charging unit 30, an exposure unit 40, a development unit 50, an intermediate transfer body 61, and a cleaning unit 75 are sequentially provided along the rotation direction. The image forming apparatus 10 is provided with a paper feeding tray 82 accommodating a printing medium P such as paper at the lower part of FIG. 1, the intermediate transfer body 61 and a fixing device 90 are sequentially provided along the transport direction of the printing medium P on the downstream of the transport direction of the printing medium P with respect to the paper feeding tray 82. The image forming apparatus 10 is provided with a transport portion 88 for reversing the front surface and the back surface of the printing medium P, one face of which is subjected to a fixing process by the fixing device 90, to feed back the printing medium P to a secondary transfer position to be described later when images are formed on both faces of the printing medium.

The photosensitive drum 20 has a cylindrical conductive base material (not shown) and a photosensitive layer (not shown) formed on the outer peripheral face thereof, and can be rotated in a direction indicated by the arrow shown in FIG. 1.

The charging unit 30 is a device for uniformly charging the surface of the photosensitive drum 20 by corona charging or the like.

The exposure unit 40 receives image information from a host computer such as a personal computer (not shown), and irradiates a laser onto the uniformly charged photosensitive drum 20, thereby forming an electrostatic latent image.

The development unit 50 has four development devices of a black development device 51, a magenta development device 52, a cyan development device 53, and a yellow development device 54, and makes the latent image visible as a toner image, selectively using the development devices corresponding to the latent image on the photosensitive drum 20. The black development device 51 performs development using black toner (K), the magenta development device 52 performs development using magenta toner (M), the cyan development device 53 performs development using cyan toner (C), and the yellow development device 54 performs development using yellow toner (Y). As described above, the toner of the invention can reliably form a desired toner image since the difference of the charging properties among the toner particles is small.

When the plural kinds of toners are used as described in the embodiment, it is satisfactory that the invention is applied to at least one kind of toner, preferably the invention is applied to plural kinds of toners, and more preferably the invention is applied to all the kinds of toners. Accordingly, the above-described effect is more remarkably exhibited, it is possible to more effectively suppress the difference of the charging properties among the toners corresponding to colors, and it is possible to easily perform bias setting in the image forming apparatus. In addition, the development efficiency for the toners corresponding to the colors can be made to be more uniform.

The YMCK development unit 50 of the embodiment is rotatable such that the four development devices 51, 52, 53, and 54 are selectively opposed to the photosensitive drum 20. Specifically, in the YMCK development unit 50, four development devices 51, 52, 53, and 54 are kept in four keeping portions 55*a*, 55*b*, 55*c*, and 55*d* of a keeping body 55 rotatable about a shaft 50*a*, four development devices 51, 52, 53, and 54 are selectively opposed to the photosensitive drum 20 by the rotation of the keeping body 55 in a state where four development devices 51, 52, 53, and 54 are kept in relative positional relation. The development devices 51, 52, 53, and 54 will be described later.

The intermediate transfer body 61 has an intermediate transfer belt 70 with an endless belt shape, and the intermediate transfer belt 70 is suspended by a primary transfer roller 60, a driven roller 72, and a driving roller 71 and is rotated by the rotation of the driving roller 71 in a direction indicated by the arrow shown in FIG. 1 at substantially the same speed as that of the photosensitive drum 20.

The primary transfer roller 60 is a device for transferring a single color toner image formed on the photosensitive drum 20 to the intermediate transfer belt 70.

A toner image with at least one color of black, magenta, cyan, and yellow is supported on the intermediate transfer belt 70, the toner images with four colors of black, magenta, cyan, and yellow are sequentially and repeatedly transferred, for example, at the time of forming a full-color image, thereby forming a full-color toner image. In the embodiment, the driving roller 71 also serves as a backup roller of a secondary transfer roller 80 to be described later. The primary transfer roller 60, the driving roller 71, and the driven roller 72 are supported by a substrate 73.

The secondary transfer roller 80 is a device for transferring a toner image with a single color or full color formed on the intermediate transfer belt 70 on the printing medium P such as paper, film, and cloth.

The fixing device 90 is a device for fixing the toner image to the printing medium P by heating and pressurizing the printing medium P to which the toner image is transferred.

The cleaning unit 75 has a rubber cleaning blade 76 in contact with the surface of the photosensitive drum 20 between the primary transfer roller 60 and the charging unit 30, and is a device for raking and removing the toner remaining on the photosensitive drum 20 by the cleaning blade 76 after the toner image is transferred onto the intermediate belt 70 by the primary transfer roller 60. As described above, since the toner of the invention has an excellent cleaning property, the toner remaining on the photosensitive drum 20 is reliably raked out and removed by the cleaning blade 76. Accordingly, it is possible to more reliably prevent a bad effect from having an influence on the image formed on the printing medium by the remaining toner.

The transport portion 88 is provided with a transport roller pair 88A and 88B pinching and transporting the printing medium P, one face of which is subjected to the fixing process by the fixing device 90, and a transport path 88C guiding the printing medium P transported by the transport roller pair 88A and 88B toward a register roller 86 while reversing the front face and the back surface. Accordingly, when images are formed on both faces of the printing medium, the printing medium P, one face of which is subjected to the fixing process by the fixing device 90, is fed back to the secondary transfer roller 80 with the front face and back face reversed.

Next, an operation of the image forming apparatus 10 configured as described above will be described.

First, the photosensitive drum 20, the development roller (not shown) provided in the development unit 50, and the intermediate transfer roller 70 start rotating by an instruction from a host computer (not shown). The photosensitive drum 20 is rolled and sequentially charged by the charging unit 30 (charging process).

The charged area of the photosensitive drum 20 reaches an exposure position by the rotation of the photosensitive drum 20, and a first color tone, for example, a latent image corresponding to image information of yellow Y is formed on the area by the exposure unit 40 (exposure process).

The latent image formed on the photosensitive drum 20 reaches a development position by the rotation of the photosensitive drum 20, and is developed into a yellow toner by the yellow development device 54 (development process). Accordingly, a yellow toner image is formed on the photosensitive drum 20. At this time, the yellow development device 54 of the YMCK development unit 50 is opposed to the photosensitive drum 20 at the development position.

The yellow toner image formed on the photosensitive drum 20 reaches a primary transfer position (i.e., an opposed portion of the photosensitive drum 20 and the primary transfer roller 60) by the rotation of the photosensitive drum 20, and is transferred (primary transfer) to the intermediate belt 70 by the primary transfer roller 60 (primary transfer process). At this time, primary transfer voltage (primary transfer bias) with a polarity reverse to a charging polarity of the toner is applied to the primary transfer roller 60. Meanwhile, the secondary transfer roller 80 is aligned away from the intermediate transfer belt 70.

The process described above is repeatedly performed for the second color tone, the third color tone, and the fourth color tone, and thus toner images of the colors corresponding to the image signals are overlapped with and transferred to the intermediate transfer belt 70. Accordingly, a full-color toner image is formed on the intermediate transfer belt 70.

The printing medium P is transported from the paper feeding tray 82 to the secondary transfer roller 80 by a paper feeding roller 84 and the register roller 86.

The full-color toner image formed on the intermediate transfer belt 70 reaches a secondary transfer position (i.e., an opposed portion of the secondary transfer roller 80 and the driving roller 71) by the rotation of the intermediate belt 70, and is transferred (secondary transfer) to the printing medium P (secondary transfer process). At this time, the secondary transfer roller 80 is pressed to the intermediate transfer belt 70, and secondary transfer voltage (secondary transfer bias) is applied.

The full-color toner image transferred to the printing medium P is heated and pressurized by the fixing device 90 to be fixed (fused) to the printing medium P (fixing process). When the toner particles include wax, the wax kept in the empty portion of the cylindrical bodies is discharged from the cylindrical bodies by pressurization or the like, and a function thereof can be made to be reliably exhibited.

Thereafter, the printing medium P is discharged to the outside of the image forming apparatus 10 by a paper discharge roller pair 87.

The toner attached to the surface of the photosensitive drum 20 is raked out by the cleaning blade 76 of the cleaning unit 75 after passing through the primary transfer position, and the photosensitive drum 20 prepares charging for forming the next latent image. The raked-out toner is collected at a remaining toner collecting unit in the cleaning unit 75.

When images are formed on both faces of the printing medium, the printing medium P, one face of which is subjected to the fixing process by the fixing device 90, is pinched by the paper discharge roller pair 87, then the paper discharge roller pair 87 is reversely driven, the transport roller pair 88A and 88B is driven to reverse the front face and the back face of the printing medium P through the transport path 88C to feed back the printing medium P to the secondary transfer roller 80, and an image is formed on the other face of the printing medium P.

The development device 54 that is an example of the development device to which the toner of the invention is applied will be described with reference to the drawings. Since the development devices 51, 52, and 53 are the same as the development device 54 except that a color of toner used is different, the description thereof is omitted.

Figure 2:
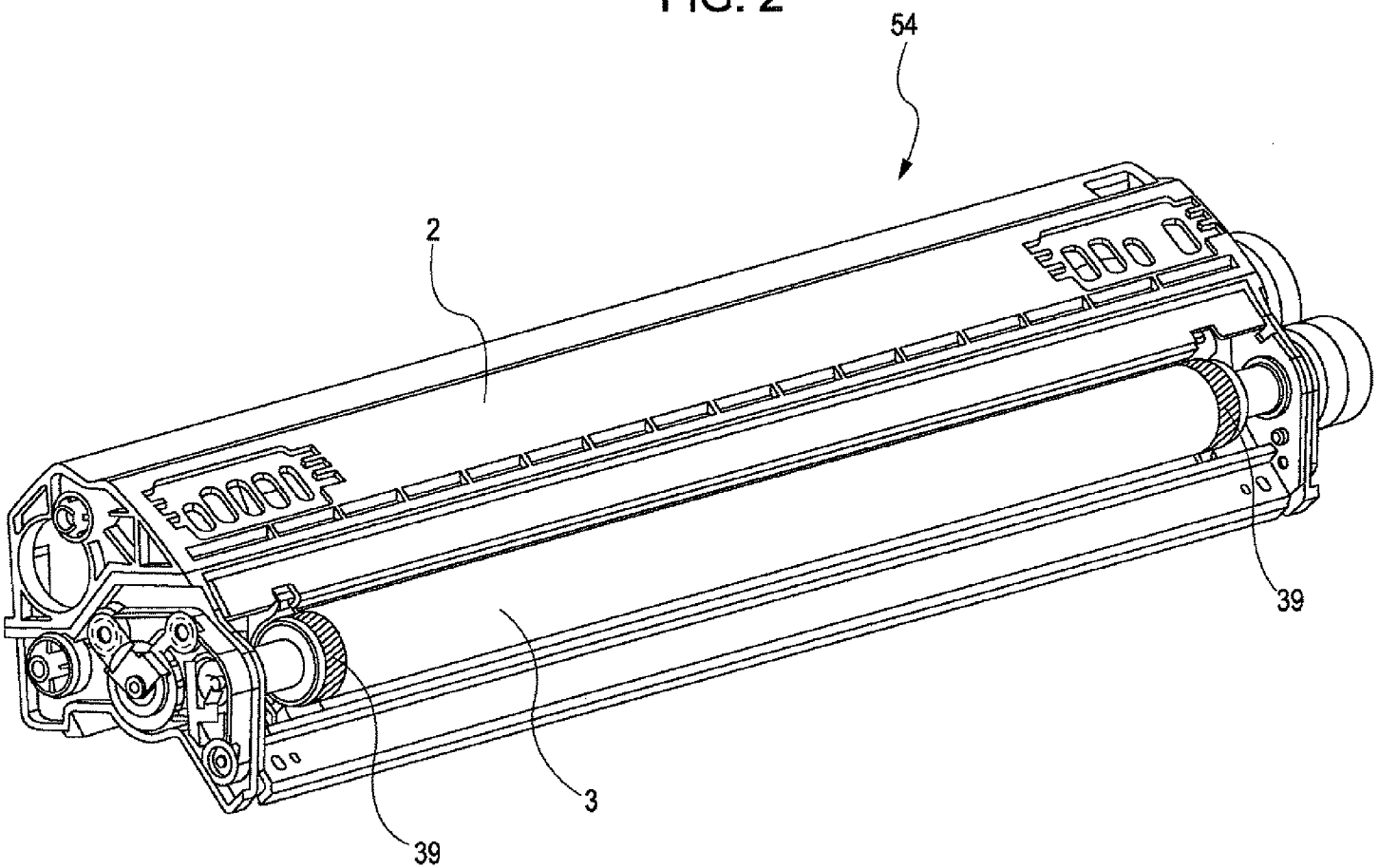
FIG. 2 is a perspective view illustrating a development device provided in the image forming apparatus shown in FIG. 1.
Figure 3:
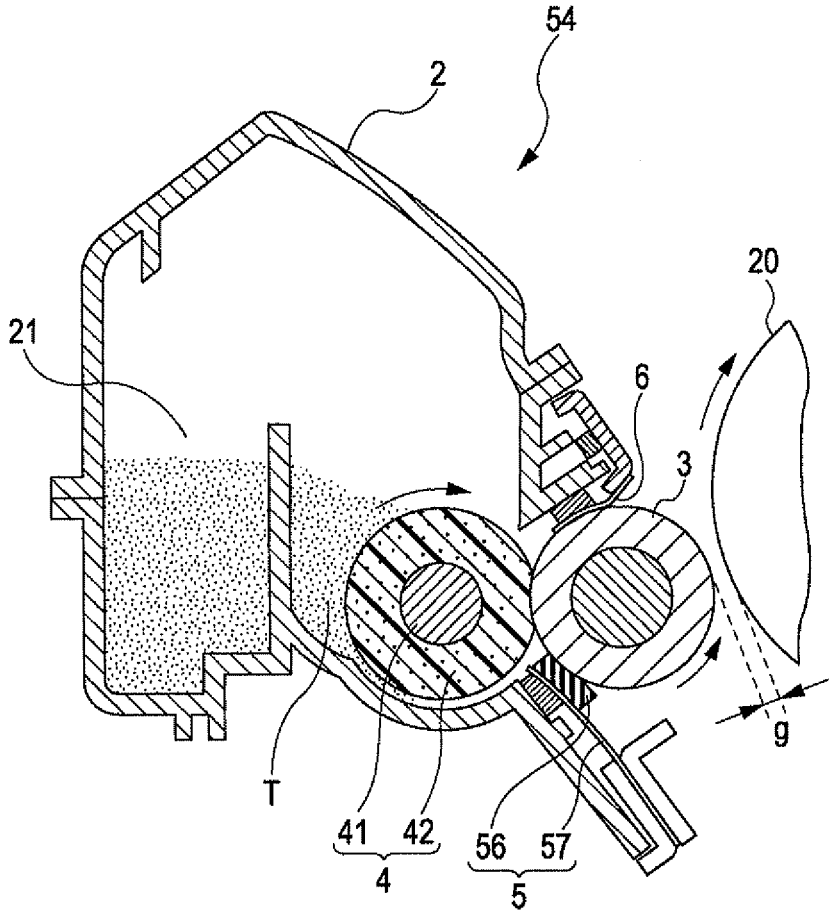
FIG. 3 is a schematic cross-sectional view illustrating a schematic configuration of the development device shown in FIG. 2.

FIG. 2 is a perspective view illustrating a development device provided in the image forming apparatus shown in FIG. 1, and FIG. 3 is a schematic cross-sectional view illustrating a schematic configuration of the development device shown in FIG. 2.

As shown in FIG. 3, the development device 54 has a housing 2 in which a toner accommodating portion 21 accommodating a toner T (toner of the invention) that is a development agent is formed, a development roller 3 supporting the toner T, a toner supply roller 4 supplying the toner T to the development roller 3, and a regulation blade 5 regulating a layer thickness of the toner T supported on the development roller 3.

The housing 2 accommodates the toner T in the toner accommodating portion 21 formed as an inner space thereof.

The housing 2 is opened to the right side in FIG. 2, and the toner supply roller 4 and the development roller 3 are rotatably supported in the vicinity of the opening portion. The housing 2 is provided with the regulation blade 5. In addition, the housing 2 is provided with a seal member 6 for preventing the toner from being leaked out from a space between the housing 2 and the development roller 3 at the opening portion.

The development roller 3 transports the toner T to a development position between the development roller 3 and the photosensitive drum 20 (hereinafter, simply referred to as a "development position") while supporting the toner T on the outer peripheral face thereof. The development roller 3 is cylindrical and is rotatable around the axial line thereof. In the embodiment, the development roller 3 rotates in a direction reverse to the rotation direction of the photosensitive drum 20. As shown in FIG. 2, a tape-shaped spacer 39 is provided on the outer peripheral face at both end portions of the development roller 3 over the whole circumference. The spacer 39 comes into press contact with an image non-supporting face of the photosensitive drum 20, and forms a development gap g between the development roller 3 and the photosensitive drum 20. The development gap g can be adjusted to a desired size according to the thickness of the spacer 39. A constituent material of the spacer 39 is not particularly limited, but it is preferable to use a material having elasticity and having a moisture absorbing property greater than that of the development roller 3. In addition, it is preferable that the spacer 39 and the development roller 3 are fixed through an adhesive having elasticity.

As described above, the development roller 3 and the photosensitive drum 20 are opposed in a non-contact state with a very small gap (space) g. Alternating current bias (alternating field) as a development bias voltage is applied between the development roller 3 and the photosensitive drum 20 to project the toner T from the development roller 3 to the photosensitive drum 20, thereby forming the latent image into the toner image on the photosensitive drum 20. That is, in the embodiment, so-called non-contact jumping development is performed. In the non-contact jumping development, the toner T flies and reciprocates between the development roller 3 and the photosensitive drum 20 by a change of voltage of the alternating bias (development bias voltage).

The toner supply roller 4 supplies the toner T from the toner accommodating portion 21 to the development roller 3 through a guide member. The toner supply roller 4 is provided with a circular or cylindrical body 41 and an elastic phosphorus layer 42 provided on the body 41. The elastic phosphorus layer 42 is formed of polyurethane foam or the like, and comes into press contact with the development roller 3 while being elastically deformed. In the embodiment, the toner supply roller 4 rotates in a direction reverse to the rotation direction of the development roller 3. The toner supply roller 4 has a function of supplying the toner T to the development roller 3, and also has a function of peeling off the toner remaining on the development roller 3 after the development from the development roller 3. In addition, voltage equivalent to the development bias voltage applied to the development roller 3 is applied to the toner supply roller 4.

The regulation blade 5 regulates the layer thickness of the toner T supported on the development roller 3, and applies electric charge to the toner T by friction charging at the regulating time. The regulation blade 5 also serves as a seal member sealing a gap between the housing 2 and the development roller 3.

The regulation blade 5 has an elastic body 56 coming into contact along the axial line direction of the development roller 3, and a support member 57 supporting the elastic body 56. The elastic body 56 is mainly formed of, for example, silicon rubber and urethane rubber. As the support member 57, a sheet-shaped thin plate having a spring property (elasticity) such as phosphor bronze and stainless steel is used, and the support member 57 has a function of biasing the elastic body 56 against the development roller 3.

In the embodiment, the regulation blade 5 is provided such that a tip end (free end) thereof is aligned to the upstream side in the rotation direction of the development roller 3, and comes into counter contact. The development device 54 of the embodiment drops down an extra toner on the development roller 3 by the regulation blade 5 and returns it to the toner accommodating portion 21.

The invention has been described above with reference to the ideally preferred embodiment, but the invention is not limited to the above description.

For example, the toner of the invention is not limited to application to the image forming device described above.

In the above-described embodiment, the cylindrical bodies are used to prepare the resin solution, but the cylindrical bodies may be used after the integration process.

In the above-described embodiment, the toner is produced using the method including the resin solution preparing process, the O/W emulsified liquid preparing process, the integration process, and the organic solvent removing process, but the toner of the invention may be produced using any method, for example, may be produced using a crushing method.

In the above-described embodiment, the case where the toner of the invention is a dry-type toner has been representatively described, but the toner of the invention may be applied to a toner for a liquid developing agent.

The portions constituting the image forming device may be replaced by arbitrary configurations which can exhibit the same functions. In addition, the arbitrary configurations may be added.

EXAMPLE

1. Production of Toner

A toner was produced as follows. In a process in which a temperature is not described, the temperature was room temperature (25° C.).

Example 1

Dispersion Liquid Preparing Process

Production of Coloring Agent Master

First, polyester resin (acid number: 10 mgKOH/g, glass transition point (Tg): 55° C., softening point: 107° C.) of 50 parts by weight as a resin material and a cyan pigment (pigment blue 15:3 manufactured by Dainichiseika Color & chemicals Mfg. Co., Ltd.) of 50 parts by weight were prepared, and they were mixed using a 20L-type Henschel mixer, thereby obtaining a raw material for toner production.

Then, the raw material (mixture) was kneaded using a 2-shaft kneading extruder. A kneaded material pushed out of an extrusion outlet of the 2-shaft kneading extruder was cooled.

The cooled kneaded material as described above was coarsely crushed to be a coloring agent master batch of an average particle diameter of 1.0 mm or less. A hammer mill was used for the coarse crushing of the kneaded material.

Preparation of Wax Master Solution

MEK (methyl ethyl ketone) 50% solution of 100 parts by weight of the polyester resin, carnauba wax (TOWAX-125 manufactured by TOA KASEI Co., Ltd.) of 16.7 parts by weight, a wax dispersion agent (Disperbyk-108 manufactured by BYK Chemie) of 1.7 parts by weight, and MKE of 80 parts by weight were dispersed by a biz mill disperser (Star Mill DMR 110 type manufactured by Ashizawa Finetech Ltd.), thereby obtaining a wax dispersion liquid.

Resin Solution Preparing Process

Methyl ethyl ketone of 148.4 parts by weight and the polyester resin of 148.5 parts by weight were mixed with 82.5 parts by weight of the coloring agent master batch by a high-speed disperser (T.K. robot mix/T.K. homo-disperse-2.5 type blade manufactured by PRIMIX Corporation), and Neogen SC-F (manufacture by Daiichi Kogyo Seiyaku Co., Ltd.) of 0.7 parts by weight as an emulsification agent, the cylindrical bodies of 2.8 parts by weight formed of silicate, and 117.9 parts by weight of wax master solution are added to produce a resin solution. In the solution, pigments and cylindrical bodies were uniformly and finely dispersed. The cylindrical bodies mainly having a smectite structure and having a sericite structure, and subjected to a surface treatment by quaternary amine (tetrahexyl ammonium) were used. An average length of the cylindrical bodies was 122 nm, an inner diameter was 71 nm, and an outer diameter was 83 nm.

O/W Emulsified Liquid Preparing Process

Then, 1-regulated ammonia water of 25.4 parts by weight was added to the resin solution in the container, it was sufficiently stirred by a high-speed disperser (T.K. robot mix/T.K. homo-disperse-2.5 type blade manufactured by PRIMIX Corporation) at a blade tip speed of the stirring blade of 7.5 m/s, a temperature of solution in a flask was adjusted to 25° C., then deionized water of 150 parts by weight was dropped while stirring was performed at a blade tip speed of the stirring blade of 14.7 m/s, and deionized water of 100 parts by weight was added while stirring was further performed, thereby obtaining an O/W emulsified liquid in which dispersoids including the resin material were dispersed through a W/O emulsified liquid.

Integration Process

Then, the W/O emulsified liquid was transferred to a stirring container having a max blend blade, and a temperature of the W/O emulsified liquid was made to be 25° C. while stirring was performed at a blade tip speed of the stirring blade of 1.0 m/s. Then, keeping the same temperature and the same stirring conditions, 5.0%-sodium sulfate aqueous solution of 119.2 parts by weight was dropped, and integration of the dispersoids was performed, thereby forming integrated particles. After the dropping, the stirring was continued until the 50% volume particle diameter Dv (50) [μm] with respect to the integrated particles was developed to 3.3 μm. When the Dv (50) of the integrated particles was 3.3 μm, deionized water of 200 parts by weight was added, and then the integration was completed.

Organic Solvent Removing Process

Then, the W/O emulsified liquid including the integrated particles was put under the decompression conditions, and the organic solvent was distilled away until the content of solid was 23 wt %, thereby obtaining a slurry (dispersion liquid) of the toner particles.

Cleaning Process

Then, solid-liquid separation was performed on the slurry (dispersion liquid), and re-dispersion (re-slurry) in water and solid-liquid separation were repeatedly performed, thereby performing the cleaning process. The cleaning process was performed until conductivity of a clear supernatant liquid of the dispersion liquid (slurry) was 20 μS/cm or lower.

Thereafter, a wet cake (toner particle cake) of the toner particles was obtained by a suction filtration method.

Drying Process

Thereafter, the obtainable wet cake was dried using a vacuum drier, thereby obtaining a toner as powder (an aggregate of the toner particles in the dry state).

The Dv (50) of the toner particles was 3.1 μm. The 50%-volume particle diameter Dv (50) [μm] of the obtainable toner particles was measured by Microtrac MT-3000 (manufactured by Nikkiso Co., Ltd.). The average circularity of the toner particles was 0.961. The circularity of the toner particles was acquired by measurement using a flow type particle shape analyzer (e.g., FPIA-3000 manufactured by Sysmex Corporation). In the following description, the same was applied to the obtainable particles in the examples and comparative examples, to acquire the average particle diameter and the average circularity.

A magenta toner, a yellow toner, and a black toner were produced in the same manner except that the cyan-based pigment was modified to a magenta-based pigment of pigment red 238 (manufactured by Sanyo Color Works Ltd.) a yellow-based pigment of pigment yellow 180 (manufactured by Clariant Co., Ltd.), a black-based pigment of carbon black (Printex L manufactured by Degussa Co., Ltd.)

Examples 2 to 13

Toners corresponding to colors were produced in the same manner as Example 1 except that the condition of the material used to produce the toner was changed as shown in Table 1.

Comparative Example 1

A toner was produced in the same manner as the example except that the cylindrical bodies were not used, in the resin solution preparing process.

Comparative Example 2

A toner was produced in the same manner as the example except that silicate (mainly formed of a smectite structure, and having a sericite structure) having a layer-shaped structure was used instead of the cylindrical bodies in the resin solution preparing process.

In the examples and comparative examples described above, the composition of the toner, the average particle diameter of the toner particles, and the average degree of circularity are shown in Table 1. In the table, polyester resin (acid number: 10 mgKOH/g, glass transition point (Tg): 55° C., softening point: 107° C.) is represented by PES, and styrene-arcrylic ester copolymer is represented by ST-AC. In Comparative Example 2, the condition of silicate (layer-shaped structure) having a layer-shaped structure was shown at the section of the cylindrical body.

supported on the development roller. Then, uniform charging was performed in which surface potential of the development roller was −300 V, surface potential of a photoreceptor was −500 V, exposure was performed on the photosensitive drum, the charging of the photosensitive drum surface was attenuated such that the surface potential was −50 V. After the toner supported on the development roller passed through a space between the photosensitive drum and the development roller, the toner on the development roller and the toner on the photosensitive drum were taken by tapes. The tapes used for taking were attached to printing paper, and densities of the toners were measured. After the measurement, a value obtained by multiplying 100 by a numerical value obtained by

TABLE 1

| | CONSTITUENT MATERIAL | | | | | | |
|---|---|---|---|---|---|---|---|
| | RESIN MATERIAL | | COLORING AGENT | CYLINDRICAL BODY | | | |
| | TYPE | CONTENT [wt %] | CONTENT [wt %] | AVERAGE LENGTH [nm] | INNER DIAMETER [nm] | OUTER DIAMETER [nm] | CONTENT [wt %] |
| EXAMPLE 1 | PES | 83.7 | 12.0 | 122 | 71 | 83 | 1.0 |
| EXAMPLE 2 | PES | 82.2 | 12.0 | 122 | 71 | 83 | 2.5 |
| EXAMPLE 3 | PES | 84.1 | 12.0 | 122 | 71 | 83 | 0.6 |
| EXAMPLE 4 | PES | 83.7 | 12.0 | 254 | 71 | 83 | 1.0 |
| EXAMPLE 5 | PES | 79.2 | 12.0 | 122 | 71 | 83 | 5.5 |
| EXAMPLE 6 | PES | 84.6 | 12.0 | 122 | 71 | 83 | 0.1 |
| EXAMPLE 7 | PES | 83.7 | 12.0 | 550 | 71 | 83 | 1.0 |
| EXAMPLE 8 | PES | 83.7 | 12.0 | 54 | 71 | 83 | 1.0 |
| EXAMPLE 9 | PES | 83.7 | 12.0 | 122 | 71 | 83 | 1.0 |
| EXAMPLE 10 | PES | 69.4 | 12.0 | 122 | 71 | 83 | 1.0 |
| EXAMPLE 11 | PES | 86.45 | 12.0 | 122 | 71 | 83 | 1.0 |
| EXAMPLE 12 | PES | 86.45 | 12.0 | 122 | 71 | 83 | 1.0 |
| EXAMPLE 13 | ST-AC | 83.7 | 12.0 | 122 | 71 | 83 | 1.0 |
| COMPARATIVE EXAMPLE 1 | PES | 84.7 | 12.0 | — | — | — | — |
| COMPARATIVE EXAMPLE 2 | PES | 83.7 | 12.0 | — | — | — | 1.0 (LAYER-SHAPED STRUCTURE) |

| | CONSTITUENT MATERIAL | | | | |
|---|---|---|---|---|---|
| | WAX | | WAX DISPERSING | AVERAGE PARTICLE | AVERAGE |
| | TYPE | CONTENT [wt %] | AGENT CONTENT [wt %] | DIAMETER [μm] | CIRCULARITY DEGREE |
| EXAMPLE 1 | CARNAUBA WAX | 3.0 | 0.3 | 3.1 | 0.961 |
| EXAMPLE 2 | CARNAUBA WAX | 3.0 | 0.3 | 3.2 | 0.946 |
| EXAMPLE 3 | CARNAUBA WAX | 3.0 | 0.3 | 3.1 | 0.964 |
| EXAMPLE 4 | CARNAUBA WAX | 3.0 | 0.3 | 3.2 | 0.959 |
| EXAMPLE 5 | CARNAUBA WAX | 3.0 | 0.3 | 3.3 | 0.902 |
| EXAMPLE 6 | CARNAUBA WAX | 3.0 | 0.3 | 3.0 | 0.974 |
| EXAMPLE 7 | CARNAUBA WAX | 3.0 | 0.3 | 3.2 | 0.930 |
| EXAMPLE 8 | CARNAUBA WAX | 3.0 | 0.3 | 3.0 | 0.970 |
| EXAMPLE 9 | PARAFFIN WAX | 3.0 | 0.3 | 3.0 | 0.963 |
| EXAMPLE 10 | CARNAUBA WAX | 16.0 | 1.6 | 3.2 | 0.958 |
| EXAMPLE 11 | CARNAUBA WAX | 0.5 | 0.05 | 3.1 | 0.960 |
| EXAMPLE 12 | PARAFFIN WAX | 0.5 | 0.05 | 3.2 | 0.961 |
| EXAMPLE 13 | CARNAUBA WAX | 3.0 | 0.3 | 3.0 | 0.964 |
| COMPARATIVE EXAMPLE 1 | CARNAUBA WAX | 3.0 | 0.3 | 3.3 | 0.984 |
| COMPARATIVE EXAMPLE 2 | CARNAUBA WAX | 3.0 | 0.3 | 3.1 | 0.972 |

2. Assessment

The following assessment was performed for the toners obtainable as describe above.

2.1 Development Efficiency

The toners obtainable by the examples and comparative examples were put into a color printer cartridge of the image forming apparatus shown in FIG. 1 to FIG. 3, the toners obtainable by the examples and comparative examples were dividing the density of the toner taken on the photosensitive drum by the total sum of the density of the toner taken on the photosensitive drum and the density of the toner taken on the development roller was acquired as development efficiency, which was assessed according to the following 4-step reference. In the table, assessment regarding an average value for 4-color toners is shown.

A: Development efficiency is 96% or more, and development efficiency is particularly good.

B: Development efficiency is 90% or more and less than 96%, and development efficiency is excellent.

C: Development efficiency is 80% or more and less than 90%, and there is no problem in practical use.

D: Development efficiency is less than 80%, and development efficiency is poor.

2.2 Charging Property (Uniformity of Charging Amount)

The toners obtainable by the examples and comparative examples were put into the cartridge of the above-described image forming apparatus.

The charging amount of the toner regulated by the regulation blade of the development device and transported to the photoreceptor was assessed by analyzing the toner on the development roller. The charging amount was measured by an E-SPART analyzer manufactured by Hosokawa Micron Corporation. The measurement conditions were an absorption flow rate of 0.2 liters/minute, a dust collection air flow rate of 0.6 liters/minute, and an ejection nitrogen gas pressure of 0.02 Mpa, the charging amount (Q/m) for each one toner was measured, and the charge amount distribution was acquired by 3000 toner counts.

In the uniformity of the charging amount of the toner, in distribution of the number of charging amounts per one toner the distribution of the charging amount gets more uniform as an absolute value of a difference between the maximum frequent charging amount ($Q_1/m_1$) and a value ($Q_2/m_2$) obtained by dividing the total charging amount of the measured toners by a measurement count (the number of pieces) gets smaller, and the distribution gets more non-uniform as the absolute value gets larger. The assessment was based on the following 5-step reference. In the table, assessment about an average value for 4-color toners is shown.

A: Absolute value of difference is 0.8 or less.

B: Absolute value of difference is larger than 0.8 and 1.0 or less.

C: Absolute value of difference is larger than 1.0 and 1.5 or less.

D: Absolute value of difference is larger than 1.5 and 2.0 or less.

E: Absolute value of difference is larger than 2.0.

2.3 Cleaning Property 8000 copies of printing of a predetermined pattern were continuously performed using the above-described image forming device, and the cleaning property was assessed by the following 4-step reference.

A: Wiped remaining material of photoreceptor surface is never recognized.

B: Wiped remaining material of photoreceptor surface is scarcely recognized.

C: Wiped remaining material of photoreceptor surface is somewhat recognized.

D: Wiped remaining material of photoreceptor surface is significantly recognized.

2.4 Offset Resistance

First, the image forming apparatus shown in FIG. 1 was prepared. In the fixing device of the image forming apparatus, a time Δt necessary for the toner to pass through a nip portion was set to 0.05 seconds. Unfixed image samples were taken using the image forming apparatus, and the following test was performed in the fixing device of the image forming apparatus. The solid attachment amount of the taken samples was adjusted to 0.50 mg/cm$^2$.

In a state where the surface temperature of the fixing roller of the fixing device constituting the image forming apparatus was set to a predetermined temperature, paper (high quality normal paper manufactured by Seiko Epson Corporation) to which the unfixed toner image is transferred was introduced into the fixing device to fix the toner image to the paper, and it was visually checked whether or not an offset occurs after the fixing.

Similarly, the set temperature of the surface of the fixing roller was sequentially changed in the range of 100° C. or more and 220° C. or less, it was checked whether or not an offset occurs at each temperature, and the temperature range in which the offset did not occur was acquired as "fixing satisfactory area" and was assessed by the following 5-step reference.

A: Width of fixing satisfactory area is 60° C. or more,

B: Width of fixing satisfactory area is 50° C. or more and less than 60°.

C: Width of fixing satisfactory area is 40° C. or more and less than 50°.

D: Width of fixing satisfactory area is 30° C. or more and less than 40°.

E: Width of fixing satisfactory area is less than 30°.

2.5 Reserving Property

Each 10 g of the toners of the examples and comparative examples was put into a sample bottle and was left in a thermostat for 72 hours of 50° C., and then it was visually checked whether or not there was a lump (cohesion), and the reserving property was assessed according to the following 4-step reference.

A: Existence of lump (cohesion) was never recognized.

B: Existence of lump (cohesion) was scarcely recognized.

C: Existence of lump (cohesion) was somewhat recognized.

D: Existence of lump (cohesion) was clearly recognized.

Such a result is shown in Table 2.

TABLE 2

| | DEVELOPMENT EFFICIENCY | CHARGING CHARACTERISTIC (UNIFORMITY OF CHARGING AMOUNT) | CLEANING PROPERTY | OFFSET RESISTANCE | PRESERVING PROPERTY |
|---|---|---|---|---|---|
| EXAMPLE 1 | A | A | A | A | A |
| EXAMPLE 2 | A | A | A | A | A |
| EXAMPLE 3 | A | A | A | A | A |
| EXAMPLE 4 | A | A | A | A | A |
| EXAMPLE 5 | B | A | A | A | B |
| EXAMPLE 6 | B | B | B | A | A |
| EXAMPLE 7 | B | B | A | B | A |
| EXAMPLE 8 | B | B | B | B | B |
| EXAMPLE 9 | B | B | A | A | B |
| EXAMPLE 10 | B | B | A | A | B |
| EXAMPLE 11 | A | A | A | C | A |

TABLE 2-continued

| | DEVELOPMENT EFFICIENCY | CHARGING CHARACTERISTIC (UNIFORMITY OF CHARGING AMOUNT) | CLEANING PROPERTY | OFFSET RESISTANCE | PRESERVING PROPERTY |
|---|---|---|---|---|---|
| EXAMPLE 12 | B | B | A | C | A |
| EXAMPLE 13 | B | B | A | B | A |
| COMPARATIVE EXAMPLE 1 | A | A | D | A | A |
| COMPARATIVE EXAMPLE 2 | B | C | C | C | B |

As clearly seen from Table 2, the toner of the invention had a small difference of the charging properties among the toner particles, and had a satisfactory cleaning property. The toner of the invention was satisfactory in development efficiency. In the toner of the invention, even when the wax was included, cohesion of the toner particles caused by transuding of the wax at the preserving time was reliably prevented from occurring, an excellent reserving property was represented, the function of the wax was reliably exhibited at the fixing time, and the offset was effectively prevented from occurring in the wide temperature area. It is thought that the reason is because, in the toner of the invention, the wax is reliably kept in the empty portion of the cylindrical bodies at the preserving time and the wax is discharged out of the cylindrical bodies at the fixing time, thereby effectively exhibiting the function of the wax.

On the contrary, in the comparative example, it was difficult to obtain a satisfactory result.

The entire disclosure of JPA No. 2010-52400, filed Mar. 9, 2010, is expressly incorporated by reference herein.

What is claimed is:

1. A toner comprising a plurality of toner particles, wherein the toner particles are formed of a resin material, a coloring agent, and cylindrical bodies comprising silicate.

2. The toner according to claim 1, wherein the toner particles further includes wax.

3. The toner according to claim 2, wherein the wax is kept in an empty portion of the cylindrical bodies.

4. The toner according to claim 1, wherein the content of the cylindrical bodies is 0.2 wt % or more and 5.0 wt % or less.

5. The toner according to claim 1, wherein the cylindrical bodies are subjected to a surface treatment by quaternary amine.

6. The toner according to claim 1, wherein the silicate has a smectite structure or a sericite structure.

7. The toner according to claim 1, wherein polyester resin is included as the resin material.

8. The toner according to claim 1, wherein an average degree of circularity of the toner particles is 0.910 or more and 0.965 or less.

9. An image forming apparatus using the toner according to claim 1.

10. An image forming apparatus comprising a plurality of development devices that form a single color image corresponding to a plurality of toner using different colors of toner, wherein at least one development device has the toner according to claim 1.

* * * * *